United States Patent [19]

Eskelinen

[11] Patent Number: 4,873,939

[45] Date of Patent: Oct. 17, 1989

[54] SHORT-DWELL COATER FOR COATING A WEB WITH COATING MIX

[75] Inventor: Juhani Eskelinen, Helsinki, Finland

[73] Assignee: Valmet Paper Machinery Inc., Helsinki, Finland

[21] Appl. No.: 120,476

[22] Filed: Nov. 13, 1987

[30] Foreign Application Priority Data

Nov. 14, 1986 [FI] Finland ..... 864649

[51] Int. Cl.[4] ..... B05C 3/02

[52] U.S. Cl. ..... 118/410; 118/413; 427/356

[58] Field of Search ..... 118/410, 413; 427/356

[56] References Cited

U.S. PATENT DOCUMENTS 4,702,196 10/1987 Krautzberger ..... 118/410

FOREIGN PATENT DOCUMENTS 3420412 12/1985 Fed. Rep. of Germany ..... 118/410

3438380 4/1986 Fed. Rep. of Germany ..... 118/410

*Primary Examiner*—Shrive Beck

*Assistant Examiner*—Alain Bashore

*Attorney, Agent, or Firm*—Birch, Stewart, Kolasch & Birch

[57] ABSTRACT

A short-dwell coater coats a web positioned against a backing roll with coating mix. The coater comprises a front lip as a part of the coater support structure, a feeder device adjacent the front lip for feeding the coating mix onto the paper web, a mouth piece (4, 5) forming an extension of the feeder device and forming an application zone (8) against the web (9), and a doctor blade mounted rearward of the application zone with respect to the forward machine direction. This blade doctoring the excess coating mix away from the web. The coater further comprises an intermediate lip (6) positioned between the feeder device and the doctor blade in conjunction with the front lip and forming together with web a space capable of acting as the application zone. This application zone will have a wedge-shaped cross-section tapering in the forward machine direction so that a side of the intermediate lip facing the doctor blade forms an obtuse angle with the exiting web in order to prevent the reflow of the doctored coating mix to the application. This coater can be used at high web speed and will prevent blending of the coating mix and doctored coating mix.

6 Claims, 2 Drawing Sheets

SHORT-DWELL COATER FOR COATING A WEB WITH COATING MIX

FIELD OF THE INVENTION

The present invention relates to a short-dwell coater for coating a web against a backing roller with coating mix.

DESCRIPTION OF THE BACKGROUND ART

In constructions of the prior art, the flow of coating material is adapted to be vorticous in the application zone, which procedure partially blends the doctored coating mix with the fresh coating mix.

A disadvantage of the conventional technology is that the doctored coating mix, which contains air and fibers, degrades the end result of coat quality.

SUMMARY OF THE INVENTION

The aim of this invention is to overcome the disadvantages associated with the prior art technology described above and to achieve a totally new kind of short-dwell coater.

The invention is based on guiding the coating mix into an application zone, which is formed between a flow guide and the web and is adapted to have a wedge-shaped cross-section tapering in the machine forward direction of the web with the aim of preventing the coating mix portion containing entrapped air from being mixed with the homogeneous coating mix portion of the application zone.

More specifically, the short-dwell coater in accordance with the invention is characterized by a short-dwell coater comprising a front lip, an intermediate lip, a mouth piece, feeder means, and doctor blade means. The mouth piece forms an application zone with the web whereat coating mix is applied to the web. This coating mix is supplied by the feeder means. The doctor blade means is positioned rearwardly of the application zone and removes excess coating mix from the web. This excess coating mix is kept separate from the mix to be applied to the web. The intermediate lip has a side facing the doctor blade means which forms an obtuse angle with the web to prevent this reflow of this excess coating mix to the application zone.

The invention provides outstanding benefits.

A short-dwell coater in accordance with the invention is capable of maintaining a consistent quality of coating mix in the application zone, whereby a steady, nonfluctuating, and nonvorticous flow in the application zone is achieved even at high web speeds. Particularly good results with respect to conventional constructions are obtained with coat pastes of high-viscosity and high solids content.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is next examined in detail with help of the exemplifying embodiment illustrated in the attached drawings which are given by way of illustration only, and thus, are not limitative of the present invention, and wherein.

DETAILED DESCRIPTION OF THE PREFERRED EMBODIMENTS

Figure 1:
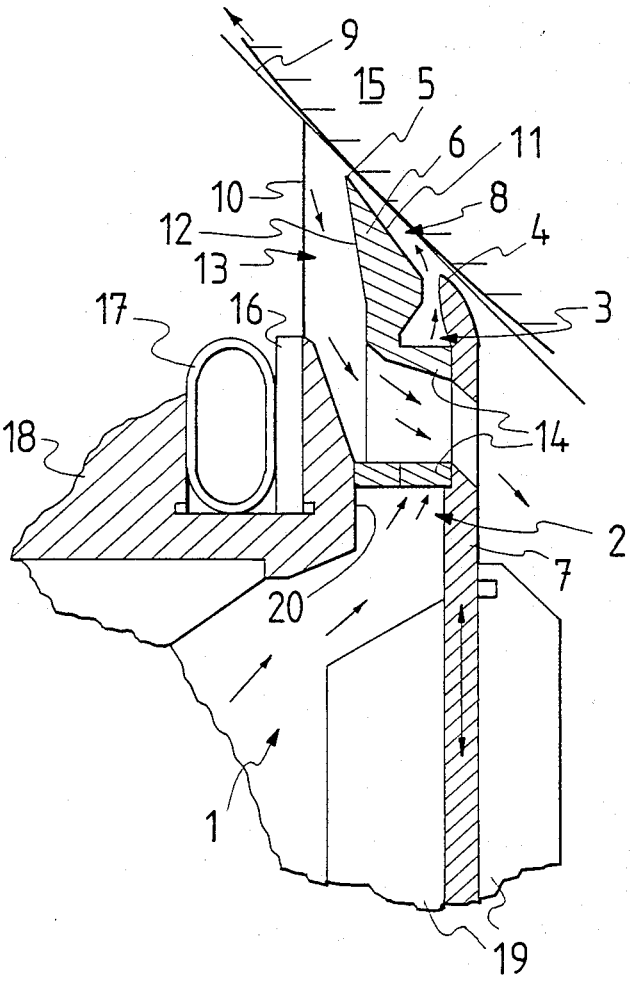
FIG. 1 illustrates a cross-sectional side view of a short-dwell coater in accordance with the present invention taken approximating plane A-A in FIG. 2.

In accordance with FIG. 1, the short-dwell coater of the present invention is positioned next to a section of a paper web 9, which is supported by a backing roll 15. The coater extends essentially over the cross-directional width of the web 9. Typical web speeds used in this kind of a coater are in the range 500. . . 1500 m/min and typical coat weights are in the range 5 . . . 16 g/m$^2$. The coating mix is fed through a feed box 1 by means of, e.g., pumps (not shown) via a feed manifold 2 adapted into a combination intermediate/front lip 6, 7 to nozzles 3. The nozzles 3 spread the mix over the entire width of the web 9 in an application zone 8, where a portion of the coating mix adheres to the web 9.

The application zone 8 is defined as the space delineated in a parallel plane of the web 9 by an adjustable lip 4 and a tip 5 of the intermediate lip 6. Further, in an orthogonal plane of the web 9, the application zone 8 is delineated by the web 9 itself and by the combination intermediate/front lip 6, 7. The application zone 8 is formed into a wedge shape cross-section, because the tip 5 of the intermediate lip 6 at the side of a doctor blade 10 is closer to the web 9 than the tip of the intermediate lip 6 at the side of the nozzle 3. The distance of the tip 5 of the intermediate lip as well as that of the adjustable lip 4 from the web 9 is adjustable by the vertical movement of the combination intermediate/-front lip 6, 7. The movement is controlled by guide blocks 19 and a glide plane 20 of a blade mounting fixture 18.

A surface 11 of the intermediate lip 6 facing the web 9 is essentially planar and forms a narrow, acute angle with the entering web 9. More specifically, the angle formed by the surface 11 of the intermediate lip 6 facing the web 9 and a tangent of the backing roll 15 at the tip 5 of the intermediate lip 6 is 3 . . . 10°, typically about 7°. The excess mix is doctored away by the doctor blade 10, which is mounted to the blade mounting fixture 18 by means of a support block 16 and a compressed-air hose 17. Further, a side 12 of the blade 10 facing the intermediate lip 6 forms a large, preferably an obtuse angle (about 150° ) with an exiting web 9 at the side of the blade 10, and thus prevents by its appropriate shape the reflow of the air-entraining, doctored mix to the application zone 8.

The doctored mix is carried from an exit box 13 via a tubular outlet manifold 14 positioned in the combination intermediate/front lip 6, 7, into the recirculation flow of the coating mix thus maintaining its flow direction as essentially the reverse of the machine direction of the web 8. The doctored, air-entraining mix will not be blended with the fresh, homogeneous mix because the feed manifold 2 is completely separated from the outlet manifold 14. In the described embodiment, the outlet manifold 14 forms a support structure for mounting the intermediate lip 6 to the plate of the front lip 7.

Figure 2:
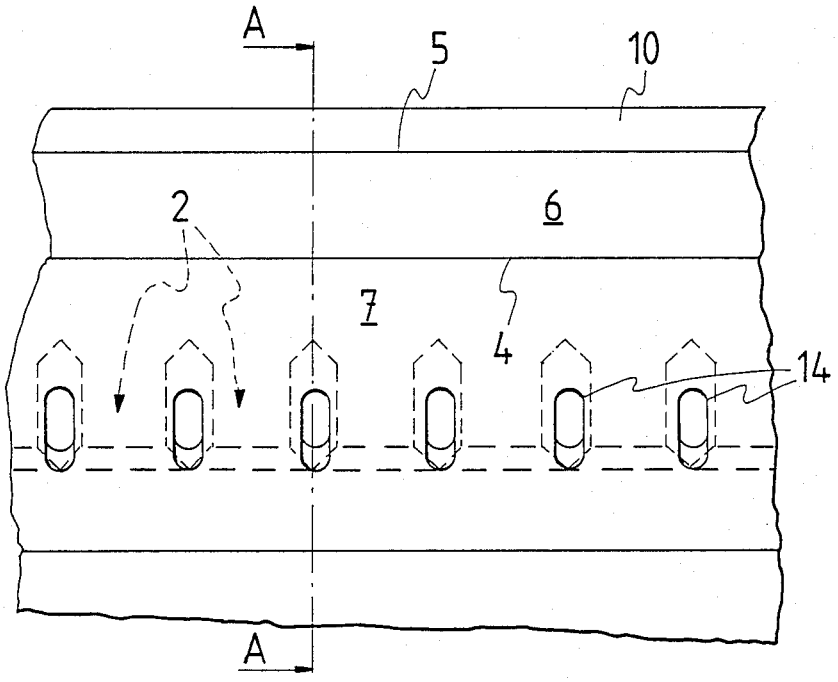
FIG. 2 shows the short-dwell coater illustrated in FIG. 1 as viewed from the web entrance direction.

In accordance with FIG. 2, the entrance opening of the outlet manifold 14 is essentially larger at the side of the blade 10, and the manifold 14 is gently downward sloping in the exit direction. The cross-section of ducts in the outlet manifold 14 is elliptical with a 3:1 ratio of height to width. The spacing of duct center points in the manifold 14 is preferably four times the width of the ducts. The feed manifold 2 is formed into the space remaining between the tubular ducts of the outlet manifold 14 in space delineated by the front lip 7 and the intermediate lip 6. The shape of ducts in the outlet manifold 14 is not essentially critical in the invention and may thence vary in, e.g., the range 3:1 . . . 4:1 for the ratio of height to width.

Apart from the wedge-shaped cross-section of the intermediate lip 6, the lip can alternatively a sheet-like cross-section.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A short-dwell coater for coating a web positioned against a backing roll, said web being coating with a coating mix as said web moves in a coating direction from a forward to a rear side of said coater, said short-dwell coater comprising:

a front lip;

an intermediate lip positioned behind said front lip;

a mouth piece formed by said front lip and said intermediate lip defining an application zone with said web whereat the coating mix is applied to the web, said front lip acts as a support for at least said intermediate lip and mouth piece;

means for moving said front lip toward and away from said web for adjusting size of the application zone;

feeder means for feeding the coating mix to the application zone, said feeder means being positioned next to said front lip; and doctor blade means positioned rearwardly of said application zone for doctoring excess coating mix away from the web, said excess coating mix being kept separate from coating mix to be applied to the web, said intermediate lip having a side facing the doctor blade means which forms an obtuse angle with the web to prevent reflow of the excess coating mix to the application zone.

2. The short-dwell coater as recited in claim 1, further comprising means for adjusting the positioning of the doctor blade means with respect to the web.

3. The short-dwell coater as recited in claim 1, wherein said application zone has a generally wedge shape cross-section.

4. A short-dwell coater for coating a web positioned against a backing roll, said web being coated with a coating mix as said web moves in a coating direction from a forward to a rear side of said coater, said short-dwell coater comprising:

a front lip;

an intermediate lip positioned behind said front lip;

a mouth piece formed by said front lip and said intermediate lip defining an application zone with said web whereat the coating mix is applied to the web;

means for moving said front lip and intermediate lip for adjusting size of the application zone;

feeder means for feeding the coating mix to the application zone, said feeder means being positioned next to said front lip; and doctor blade means positioned rearwardly of said application zone for doctoring excess coating mix away from the web, said excess coating mix being kept separate from coating mix to be applied to the web, said intermediate lip having a side facing the doctor blade means which forms an obtuse angle with the web to prevent reflow of the excess coating mix to the application zone.

5. A short-dwell coater for coating a web positioned against a backing roll, said web being coated with a coating mix as said web moves in a coating direction from a forward to a rear side of said coater, said short-dwell coater comprising:

a front lip;

an intermediate lip positioned behind said front lip;

a mouth piece formed by said front lip and said intermediate lip defining an application zone with said web whereat the coating mix is applied to the web;

feeder means for feeding the coating mix to the application zone, said feeder means being positioned next to said front lip;

doctor blade means positioned rearwardly of said application zone for doctoring excess coating mix away from the web, said excess coating mix being kept separate from coating mix to be applied to the web, said intermediate lip having a side facing the doctor blade means which forms an obtuse angle with the web to prevent reflow of the excess coating mix to the application zone; and a tubular outlet manifold extending from the side of said intermediate lip facing the doctor blade means to the front lip, said outlet manifold removing the excess coating mix while keeping the excess coating mix separate from the coating mix to be applied to the web.

6. A short-dwell coater for coating a web positioned against a backing roll, said web being coated with a coating mix as said web moves in a coating direction from a forward to a rear side of said coater, said short-dwell coater comprising:

a front lip;

an intermediate lip positioned behind said front lip;

a mouth piece formed by said front lip and said intermediate lip defining an application zone with said web whereat the coating mix is applied to the web;

feeder means for feeding the coating mix to the application zone, said feeder means being positioned next to said front lip;

doctor blade means positioned rearwardly of said application zone for doctoring excess coating mix away from the web, said excess coating mix being kept separate from coating mix to be applied to the web, said intermediate lip having a side facing the doctor blade means which forms an obtuse angle with the web to prevent reflow of the excess coating mix to the application zone; and an outlet manifold positioned proximate to said doctor blade means for removing the excess coating mix while keeping the excess coating mix separate from the coating mix to be applied to the web.

* * * * *